United States Patent [19]

Funk et al.

[11] 4,077,326

[45] Mar. 7, 1978

[54] IMPULSE COMPENSATED CONTINUOUS ROD WARHEAD

[75] Inventors: Albert G. Funk; Gary L. Hansen, both of Salt Lake City, Utah

[73] Assignee: The United States of America as represented by the Secretary of the Navy, Washington, D.C.

[21] Appl. No.: 24,911

[22] Filed: Mar. 19, 1970

[51] Int. Cl.[2] ..... F42B 13/48

[52] U.S. Cl. ..... 102/67

[58] Field of Search ..... 102/67

[56] References Cited

U.S. PATENT DOCUMENTS

| | | | |
|---|---|---|---|
| 3,223,037 | 12/1965 | Nooker et al. | 102/67 |
| 3,228,336 | 1/1966 | Kempton | 102/67 |
| 3,434,422 | 3/1969 | Herman et al. | 102/67 |

*Primary Examiner*—Verlin R. Pendegrass

*Attorney, Agent, or Firm*—Richard S. Sciascia; Ervin F. Johnston

[57] ABSTRACT

An impulse compensated continuous rod warhead including a pair of end plates; an annular or cylindrical explosive charge mounted between the end plates for providing an outward exploding impulse; a plurality of continuous rods mounted about the charge, and an annular buffer assembly disposed between the charge and the rods wherein a portion of said buffer assembly has varying mass between its ends so that the explosive impulse variation from end to end is substantially evened out before accelerating the rods.

5 Claims, 5 Drawing Figures

INVENTORS.
ALBERT G. FUNK
GARY L. HANSEN
BY
ERVIN F. JOHNSTON
ATTORNEY.

SEGMENT VELOCITY VS. DISTANCE FROM INITIATOR END FOR SEGMENTS PROPELLED FROM A ROD WARHEAD WITH AND WITHOUT END CONFINEMENT

FIRST APPROXIMATION OF SHAPED BUFFER PROFILE REQUIRED TO SLOW ROD SEGMENTS OF FIG. 3 TO CONSTANT VELOCITY UTILIZING THE EQUATION $T_b = T_0((V_S/V_C)^{2.4} - 1)$

IMPULSE COMPENSATED CONTINUOUS ROD WARHEAD

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

In a continuous rod warhead an explosive charge propells a series of interconnected rods radially outward in order to cut and destroy a target. In most of these warheads the charge is in the shape of an annulus or cylinder and the rods are disposed longitudinally in a parallel fashion around the perimeter of the charge. Adjacent rods are joined together by welds at their ends so that upon detonation of the explosive charge the rods expand toward a continuous circle.

A serious problem associated with prior art continuous rod warheads has been the uneveness of the explosive impulse applied to the rods along their lengths. In order to minimize this problem we have tested initiation of an explosive charge at a center location and an end location, by both plane wave initiation and point initiation techniques. We have found that a booster located at the center of one end of the explosive charge provided the best results, however, the impulse applied to the rods is still uneven upon detonation of the cylindrical explosive charge. The result of this uneven impulse is the breaking of the rods. When the rods break they scatter in various directions and leave large gaps so as to lessen the kill probability of the warhead. The most desirable condition is for the rods to expand in a continuous interconnected relationship toward a circle so as to ensure impact with any target within the plane of such circle. It should be noted that the rods could be made strong enough to withstand the maximum impulse variation by increasing their size, however, this decreases the dynamic capabilities of the weapon and its kill probability.

SUMMARY OF THE INVENTION

We have overcome the aforementioned problem associated with prior art continuous rod warheads by providing a contoured buffer of heavy material disposed between the explosive charge and the rods so as to equalize the impulse imparted to all portions of the rods. We have found that the results were most satisfactory when the contoured buffer was used in combination with fairly heavy end plates. These end plates partially reduce the propulsion velocity gradient along the rods and the contoured buffer completely compensates for the remaining velocity gradient. It should be noted that the contoured buffer provides a varying mass along the explosive charge. It is this varying mass that evens out the explosive impulse prior to being applied to the rods. We have further discovered that a multilayered buffer provides surprising results in the operation of the warhead. When buffering materials of balsa wood, steel, and cellulose acetate were disposed between the explosive charge and the rod bundles the rods expanded in an optimum fashion.

STATEMENT OF THE OBJECTS OF THE INVENTION

An object of the present invention is to provide a continuous rod warhead wherein the explosive impulse imparted to all portions of the rods is substantially equalized.

Another object is to optimize the performance of continuous rod warheads.

Other objects and many of the attendant advantages of this invention will be readily appreciated as it becomes better understood by reference to the description and accompanying drawings which follow.

DESCRIPTION OF THE PREFERRED EMBODIMENT

Figure 1:
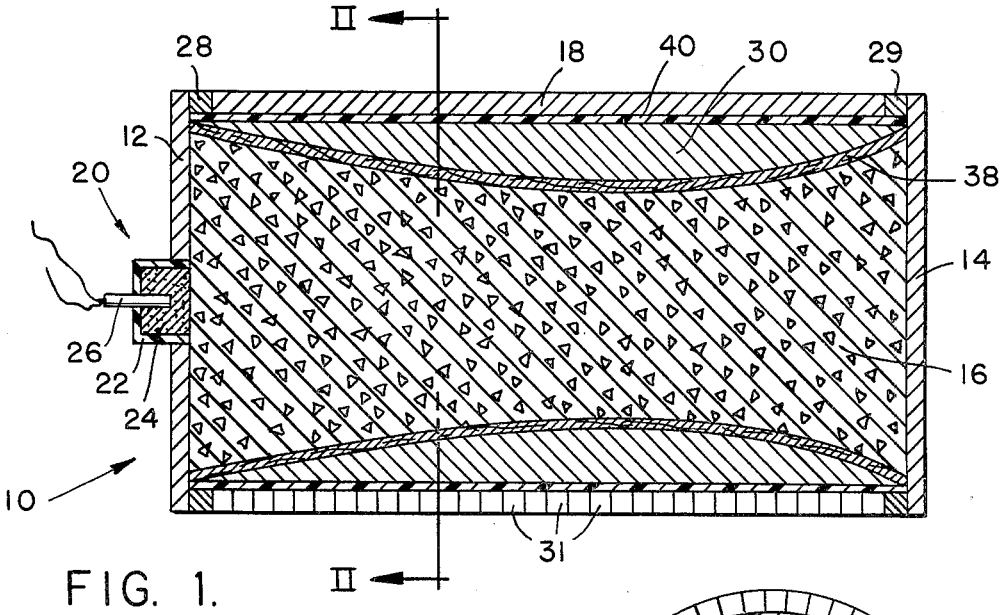
FIG. 1 is a side view, partially broken away, of a continuous rod test warhead.

Referring now to the drawings wherein like reference numerals designate like or similar parts through the several views, there is shown in FIG. 1 a continuous rod warhead 10. The warhead has a pair of oppositely disposed end plates 12 and 14, and mounted between the end plates is a cylindrical explosive charge 16 for providing a radial explosive impulse. It is desirable that the explosive be of the high impulse type such as composition B. Mounted in a parallel lengthwise fashion about the charge are a plurality of continuous rods 18. These rods are interconnected at their ends in a continuous chain so that upon detonation of the explosive charge 16 the rods expand toward a ring. While only one layer of rods 18 is illustrated in the test warhead of FIG. 1, it is to be understood that two layers are generally utilized, in which event the adjacent rods of both layers would be interconnected so that all of the rods cooperatively expand toward a ring. The common method of joining the ends of the rods is by welding so that upon expansion of the rods adjacent rods pivot with respect to one another at the weld. We have found that it is most desirable for the rods to have a uniform cross section so that the rods along their lengths and at the welds have substantially the same strength. In this manner the rods are like a chain with no weak links. The preferred rod design is a double layer of 3/16 inch square rods.

In order to detonate the explosive charge 16 a detonator 20 may be located at one end of the charge, and may be adjacent to or embedded within the charge. The detonator 20 may include a thin plastic or metal container 22 in which there is contained a booster charge 24, and an explosive initiator 26 may extend through an outer end of the container 22 into the booster 24. It should be noted that the detonator 20 is located at the center of one end of the explosive charge 16. We have found this type of initiation to be preferable over either center initiation or plane wave end initiation.

We have found it desirable to construct the end plates 12 and 14 of a heavy metal such as steel. By constructing the end plates of sufficient mass they will confine the explosive gases so that the end losses will be minimized and maximum impulse will be provided in a radially outward direction. End plates with a thickness of ½ inch have been found to be quite satisfactory for the design tested. Adjacent the plates 12 and 14 there may be located rings 28 and 29 respectively.

When the rods 18 are located directly adjacent to the explosive charge 16 and explosive force is applied to the rods 18 which is uneven along their lengths. This causes the rods to fracture at the points of greatest differential impulse, thus breaking the desirable ring effect. When this ring of rods is broken, gaps develop and the kill probability of the weapon decreases. We have overcome this problem by providing an annular buffer 30 which is disposed between the explosive charge 16 and the rods 18. This buffer has a varying mass between its ends so that impulse variation from end to end of the explosive charge 16 is substantially evened out prior to application to the rods 18. For a detonator which extends through one end of the plates and is located at a respective end of the charge, as shown in FIG. 1, the explosive impulse progresses to a maximum at about ⅔ the distance from the detonator end. Accordingly, we have provided the buffer 30 with a mass which progressively and monotonically increases from both end plates to a maximum at about two-thirds the distance from the detonator end of the explosive charge 16. The most desirable configuration of the buffer 30 will be described in detail hereinbelow. The buffer 30 may be constructed of a heavy metal, such as solid lead or steel, or it may be a mixture of heavy metal particles, such as lead in powder form, in a binder, such as a plastic or an epoxy resin. As the explosive impulse progresses the buffer fragments and these fragments impose the desired explosive retardation along the warhead.

Figure 5:
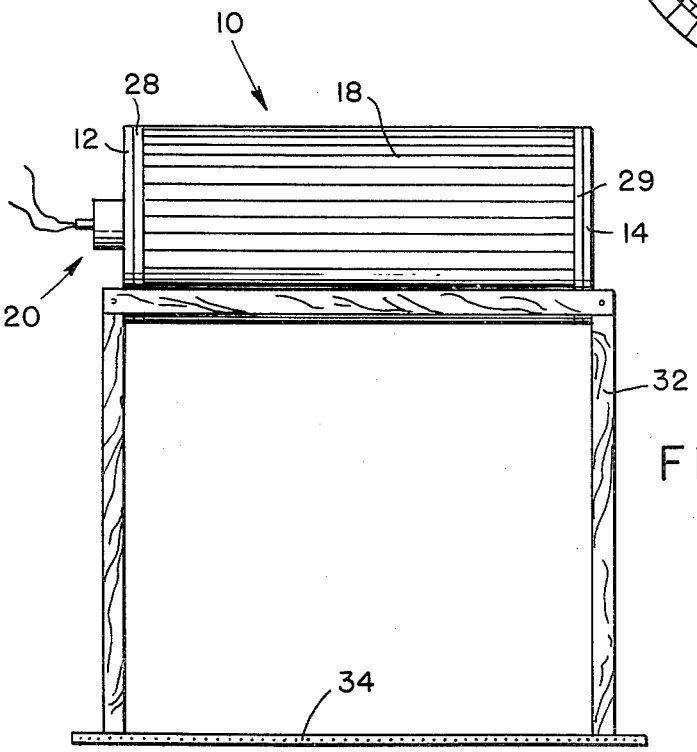
FIG. 5 is a side view of a test setup for measuring rod segment velocities of a continuous rod warhead.
Figure 3:
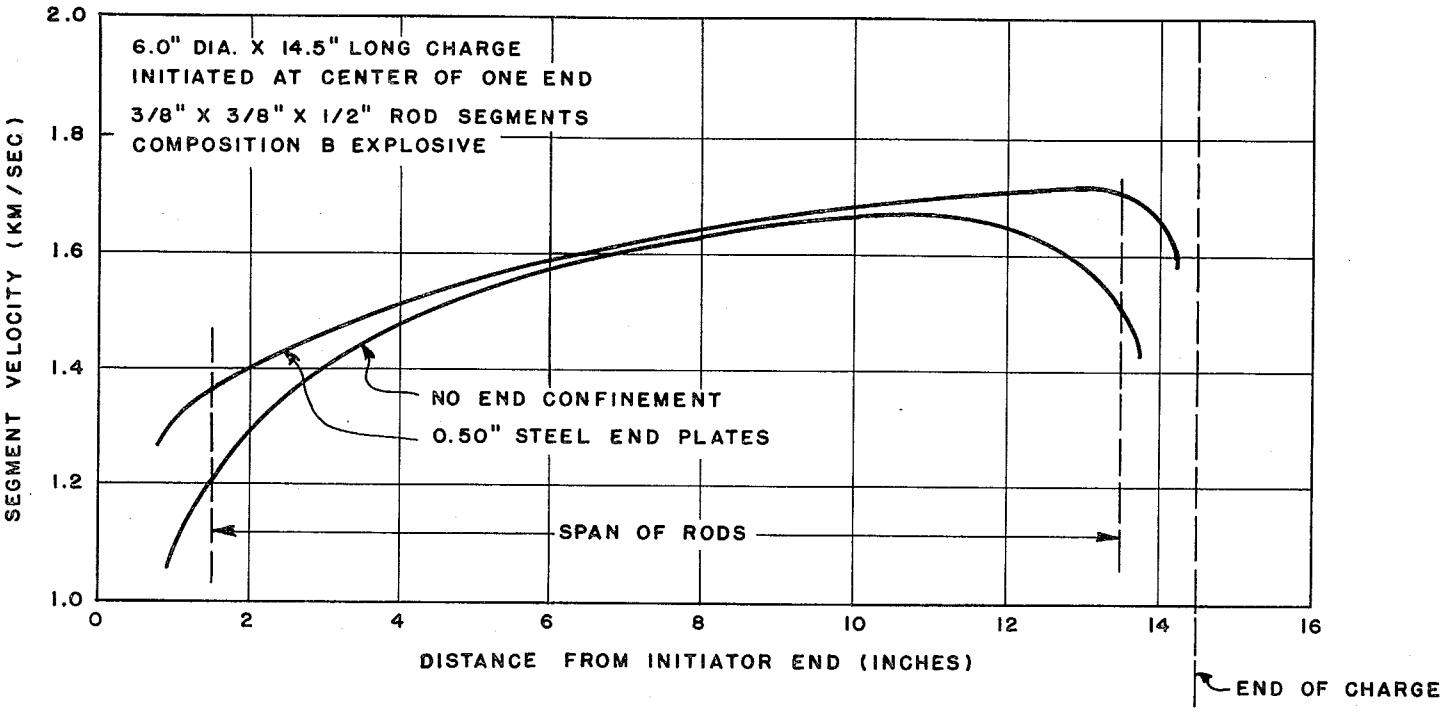
FIG. 3 is a graph of velocity of rod segments in a test setup versus distance from detonator end for an uncompensated continuous rod warhead with and without end confinement.

The buffer contour required to compensate for the variation in impulse along the rods may be determined by first testing the warhead with a constant minimum thickness of buffer, and then calculating the mass required to slow the higher velocity portions of the rods to a constant level. FIG. 3 is a graph of segment velocity vs distance from the detonator end for an uncompensated warhead with and without end plates. The segment velocity is the velocity of a rod which has been segmented along its length for test purposes. A rod is shown in segments at 31 in FIG. 1. In our tests we cut a single ⅜ inch square rod into ½ inch segments along its length. A test setup is illustrated in FIG. 5 wherein the test warhead is mounted at the top of a support 32 with the segmented rod 31 facing a downward direction. At the bottom of the support 32 is a backlighted grid 34 which the segments penetrate and cut off the light which is transmitted through the grid. A high speed streak camera trace of the grid along with electronic timing data provides the time of travel of each segment from the time the detonation wave strikes the rod segment to the time it penetrates the grid. Thus, the velocity of each segment along the length of the charge is obtained.

Figure 4:
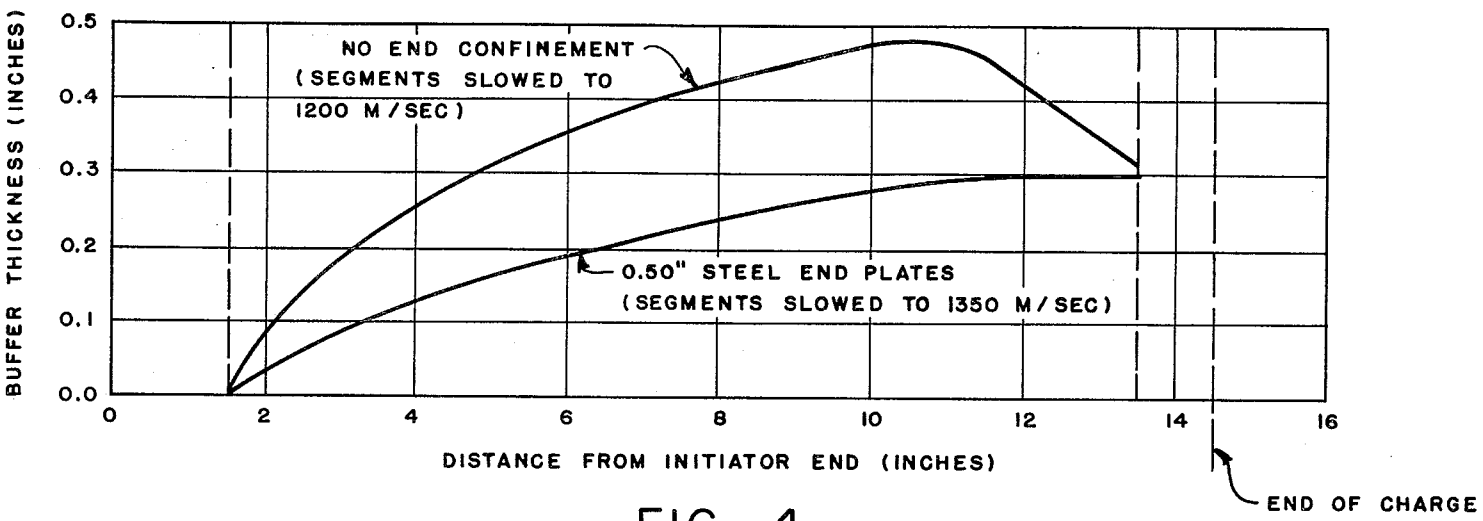
FIG. 4 is a graph of buffer thickness versus distance from the detonator end.

It may be seen from FIGS. 3 and 4 that considerably less mass compensation is required for the charge with end confinement. Thus, higher rod velocity and kill probability are obtained through the use of end plates.

In our preferred embodiment the contoured buffer 30 is sandwiched between additional buffering layers 38 and 40 which are maintained at constant thickness. The layer 38, which is adjacent to the explosive charge 16, is a pressure absorbing layer and may be constructed of balsa wood or other low density material, such as rubber or plastic foam, paper, fiberglass, or fiberboard. The density of the layer 38 should be similar to or lower than that of balsa wood. The layer 40 is adjacent to the rods 18 and may be constructed of cellulose acetate or other plastic material, such as polyethylene or styrene. The balsa wood layer 38 acts similarly to an air gap resulting in an initial lowering of the intensity of the shock wave, and the cellulose acetate layer 40 acts as a lubricant after being melted by the impact of the shock wave so as to allow the bundle of rods 18 to expand more smoothly.

In our tests the continuous rod warhead has the following dimensions and specifications:

Length of the explosive charge 16: 14.5 inches

Outside greater diameter of the explosive chage 16: 6 inches

Composition of the explosive charge 16: Composition B

Material and thicknesses of the ends plates 12 and 14: ½ inch steel

Material and dimensions of the rods 18: ⅜ inch × ⅜ inch × 12 inch steel (not welded).

Minimum buffer thickness: 1/16 inch thick balsa wood, 1/32 inch thick steel, 1/32 inch thick cellulose acetate.

Figure 2:
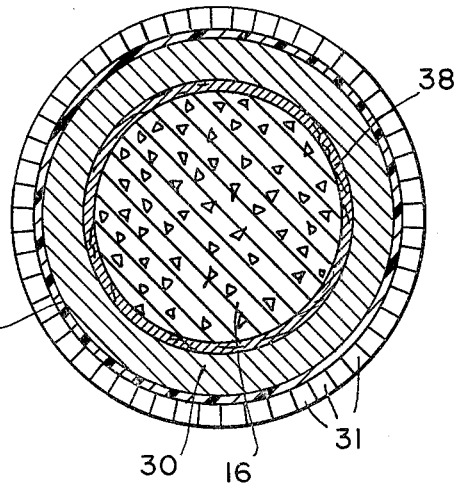
FIG. 2 is a cross sectional view taken along plane II—II of FIG. 1.

In testing warheads for segment velocity variation and buffer contours required for compensation, it is not necessary that a full array of welded rods be utilized around the periphery; rather, it is only necessary to simulate the confinement of such rods. A single layer of ⅜ inch square rods provides essentially the same confinement as a double layer of 3/16 inch square rods; therefore the larger rods were used for convience and are shown in FIGS. 1, 2 and 5.

Through our experience in detonating hundreds of warheads of various sizes and explosive to metal mass ratio's, we have developed precise techniques and formulas relating the mass and velocity of fragments or rod segments. Generally, fragments of various mass (thickness) propelled from the same point on a charge will be propelled at approximately constant kinetic energy, which is to say the mass required to slow a fragment down may be approximated from a ratio of velocities squared. More exactly, for a 6-inch diameter charge of Composition B, the relationship between velocity and mass has been found to be:

$$MV^{2.4} = \text{Constant}$$

or $$M_o V_s^{2.4} = (M_b + M_o)\, V_c^{2.4}$$

where $M_o$ is the mass of the rods and minimum buffer, which resulted in an uncompensated segment velocity $V_s$, and $M_b$ is the additonal mass of buffer, required to lower the segment velocity to $V_c$. Where the contoured buffer is to be made of solid steel or other material of the same density as the rods, and where the mass of the balsa wood and cellulose acetate are considered insignificant, the above equation can be reduced to obtain the buffer thickness directly:

$$t_b = t_o[(V_s/V_o)^{2.4} - 1]$$

FIG. 4 is a graph of the buffer thickness required to slow the segments 31 to a constant velocity as determined from this equation. Generally, one buffer correction utilizing this equation will result in a sufficiently uniform velocity such that no further correction is necessary; however, for other explosives and warhead designs secondary and possibly additional corrections may be required, in which case a segmented rod warhead with the first approximation of a contoured buffer is tested and adjusted for variation in segment velocity. For warheads of similar length and rod size to the example given, the buffer shape of FIG. 4 may serve as a good approximation from which only one secondary correction may be required.

Thus, buffer 30 configured to the proper shape will provide appropriate degrees of mass along the explosive charge 16 so that the explosive impulse applied to the rods 18 is constant along their full lengths. In this manner, the rods 18 will expand in a connected fashion toward a ring so as to ensure impact with any target which lies within the plane of this ring. The various components of the warhead may be secured together by an epoxy or welding. For instance, the rings 28 and 29 may be welded to the ends of the buffer 30 and the plates 12 and 14 may be bonded to the rings 28 and 29.

In the operation of the invention the continuous rod warhead 10 may be mounted in a missile (not shown) with the outer thinly constructed skin of the missile surrounding the warhead. Upon detonation of the detonator 20, the main explosive charge is initiated and detonates toward the terminal end. As the charge 16 detonates from one end to the other a highly progressive radial impulse is applied to the buffer 30 where the impulse is evened out and subsequently applied to the rods 18. During this phase of the operation the end plates 12 and 14 provide sufficient confinement to reduce the end losses for a more uniform radially outward impulse and a more efficient utilization of the volume and weight of the warhead. The rods then expand in an interconnected fashion and pivot around their welded ends toward a ring configuration. In this manner impact will be ensured with any target which comes within the plane of the continuous ring.

It should be noted that the present invention can be utilized for rod warheads which are initiated at locations other than at the end. For instance, the detonation could occur at the center of an annular charge. With such an arrangement the buffer is simply contoured according to the above teachings to even out the impulse along the charge.

Obviously many modifications and variations of the present invention are possible in the light of the above teachings. It is therefore to be understood that within the scope of the appended claims the invention may be practiced otherwise than as specifically described.

We claim:

1. An impulse compensated continuous rod warhead comprising:

a pair of end plates;

a cylindrical explosive charge mounted between the end plates for providing an outward explosive impulse;

a plurality of continuous rods mounted in parallel lengthwise fashion about the charge;

an annular buffer disposed between the charge and the rods;

said buffer having a varying mass between its ends so that impulse variation from the transient explosive reaction is substantially evened out before being applied to the rods;

said end plates being constructed of metal with sufficient mass to substantially reduce end losses for maximum radial impulse;

a detonator extending through one of the end plates and located at the center of the respective end of the charge;

the mass of the buffer progressing to a maximum at a point of maximum radial impulse which is located between the end plates approximately two-thirds of the length of the charge from the detonator end; and the progression of the mass being monotonic and increasing throughout the entire distances between the end plates and said point of maximum radial impulse.

2. A continuous rod warhead as claimed in claim 1 wherein: the buffer is constructed of metal particles in a binder, such as epoxy or plastic.

3. A continuous rod warhead as claimed in claim 2 including: an annular layer of balsa wood disposed between the explosive charge and the buffer.

4. A continuous rod warhead as claimed in claim 2 including: an annular layer of cellulose acetate disposed between the buffer and the rods.

5. A continuous rod warhead as claimed in claim 4 including: an annular layer of balsa wood disposed between the explosive charge and the buffer.

* * * * *